US007380764B2

(12) United States Patent
Wanamaker

(10) Patent No.: US 7,380,764 B2
(45) Date of Patent: Jun. 3, 2008

(54) PRAYER RUG/QURAN STAND

(76) Inventor: Joseph Wanamaker, 1640 N. 6th St., Philadelphia, PA (US) 19122

( * ) Notice: Subject to any disclaimer, the term of this patent is extended or adjusted under 35 U.S.C. 154(b) by 0 days.

(21) Appl. No.: 10/953,780

(22) Filed: Sep. 30, 2004

(65) Prior Publication Data

US 2005/0072885 A1 Apr. 7, 2005

Related U.S. Application Data

(60) Provisional application No. 60/508,275, filed on Oct. 6, 2003.

(51) Int. Cl.
*A47B 19/00* (2006.01)

(52) U.S. Cl. ..... 248/441.1; 248/127; 248/460; 211/45; 211/195

(58) Field of Classification Search ..... 248/125.1, 248/127, 441.1, 460; 211/195, 198, 200, 211/202, 85.3, 16, 42, 45, 46; 223/106, 120; D3/23, 26

See application file for complete search history.

(56) References Cited

U.S. PATENT DOCUMENTS 651,058 A 6/1900 Rogers
D63,001 S 9/1923 Michelbach
D132,166 S * 4/1942 Cloutier ..... D6/420
3,079,725 A * 3/1963 La Flenr ..... 248/441.1
3,139,696 A 7/1964 Stucky et al.
D234,016 S 12/1974 Smilowitz
3,955,722 A * 5/1976 Bard ..... 223/106
D244,754 S * 6/1977 Bard ..... D15/66
D254,740 S * 4/1980 Orr et al. ..... D15/66
D357,825 S * 5/1995 Gillam ..... D6/419
5,636,824 A * 6/1997 Biasini et al. ..... 248/441.1
D391,706 S 3/1998 Malcolm
2004/0149880 A1* 8/2004 Mitchell et al. ..... 248/441.1

FOREIGN PATENT DOCUMENTS

FR 2547179 A1 * 12/1984

* cited by examiner

*Primary Examiner*—Korie Chan
(74) *Attorney, Agent, or Firm*—Richard C. Litman

(57) ABSTRACT

A prayer rug stand having a base, a centrally located vertical post rising from the base, a horizontal cross bar supported at is central portion by the vertical post. The cross bar serves as a rug suspension bar. Another embodiment has arched brackets extending outward from each end of the cross bar with a rug suspension bar attached between the arched brackets so as to space the rug suspension bar from the cross bar. In an augmented version, a book holder for the QURAN is provided on the upper end portion of the vertical post on the side opposite the arched brackets and rug suspension bar. The book holder is supported at an angle to retain the book in the holder when the book is not in use. The book may be opened to a desired page while remaining stable supported by the book holder or support.

13 Claims, 4 Drawing Sheets

PRAYER RUG/QURAN STAND

CROSS-REFERENCE TO RELATED APPLICATION

This application claims the benefit of U.S. Provisional Patent Application Ser. No. 60/508275, filed Oct. 6, 2003.

BACKGROUND OF THE INVENTION

1. Field of the Invention

The present invention relates to support stands. More particularly, the present invention relates to a prayer rug stand that may have a book holder incorporated therein.

2. Description of the Related Art

The practice of religion, particularly the Muslim religion, requires the use of a prayer rug. Such a rug is normally rolled and stored in a closet, a corner of the room or on a shelf, for example. It would be desirable to provide a stand for a prayer rug that makes it easily reachable and compactly stored between uses, while displaying the rug for easy identification of the rug when stored among several rugs on similar stands. This would allow the convenient recognition and use of the rug by the owner/worshiper that, in turn, makes it practical to store a large number of rugs on such stands within a single place of worship such as a mosque. The stand should be easily transportable so as to be easily moved from room to room in a building. It would also be desirable to provide such a stand having a support for a book such as a holy book, more particularly the QURAN making it available to the owner for studying and reading in the prayer setting. The stand would then be conveniently available to store the prayer rug and holy book after use.

Thus a prayer rug/QURAN stand solving the aforementioned problems is desired.

SUMMARY OF THE INVENTION

The prayer rug stand of the present invention in its most simple form is easily portable, having a base, a centrally located, vertical post rising from the base, and a horizontal cross bar having opposed end portions and supported at its central part by the vertical post. The cross bar serves as a rug suspension bar.

Another version of the prayer rug stand of the present invention is also easily portable and has arched brackets extending outward from each end portion of the cross bar and having a rug suspension bar attached between the arched brackets at their respective remote ends so as to space the rug suspension bar from the cross bar. In an augmented version, a book holder for a Holy book, more particularly the QURAN, is provided on the upper end portion of the vertical post on the side opposite the arched brackets and rug suspension bar. The book holder is supported at an angle relative to the post by a generally triangular bracket so as to display the book while the weight of the book acts downward to retain the book in the holder when the book is not in use. The book may be opened to a desired page while remaining stably supported by the book holder or support.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a prayer rug stand which, in its most simple form, is easily portable and has a base, a centrally located, vertical post rising from the base, and a horizontal cross bar supported at its central part by the vertical post. The cross bar serves as a rug suspension bar.

Another version of the prayer rug stand of the present invention has a rug suspension bar attached between arched brackets and the cross bar. In an augmented version, a book holder for a Holy book, more particularly the QURAN, is provided on the upper end portion of the vertical post on the side opposite the arched brackets and rug suspension bar.

Figure 1:
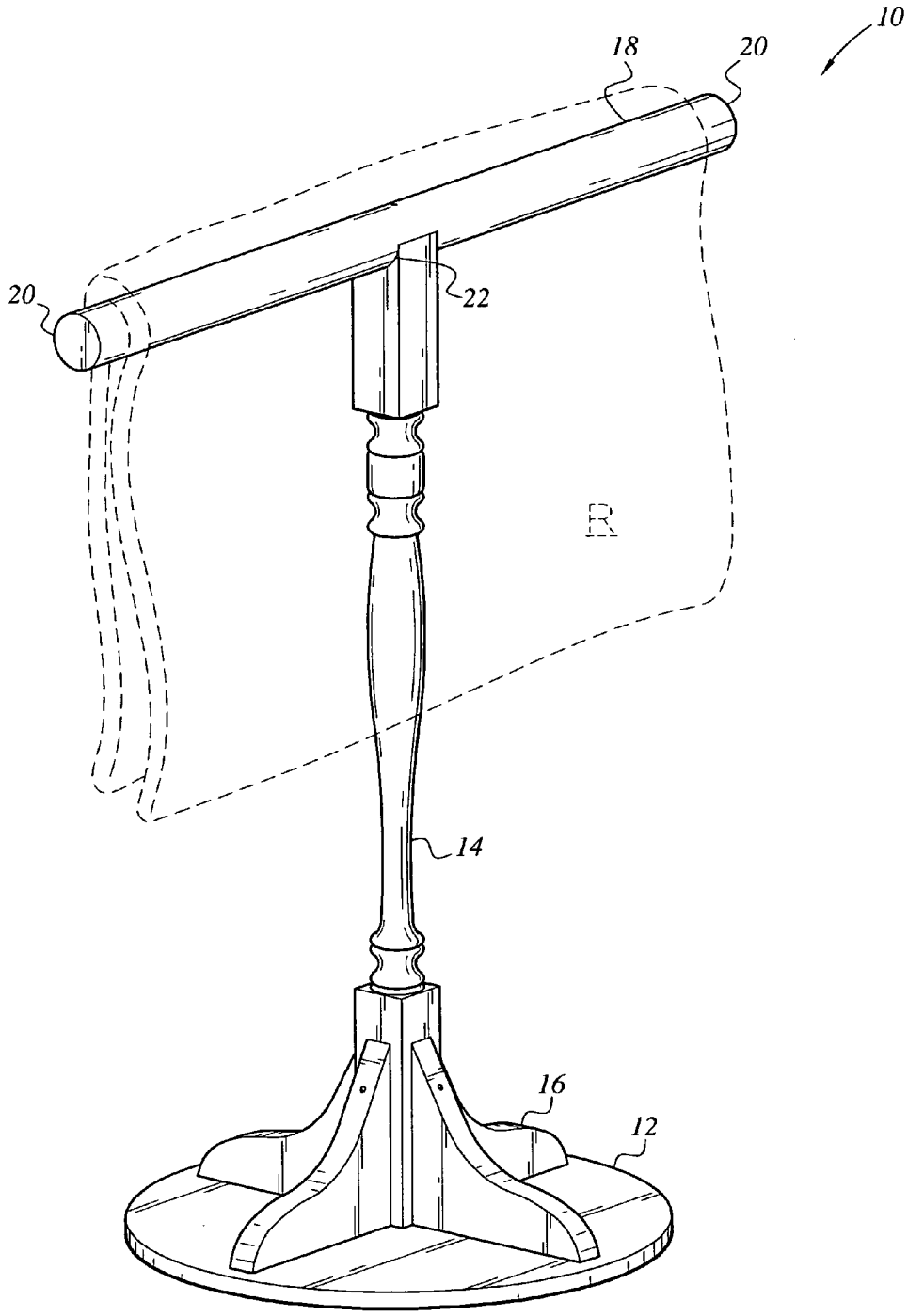
FIG. 1 is an environmental, perspective view of a prayer rug stand according to the present invention.

Referring to FIG. 1, there is shown a perspective view of prayer rug stand 10, having a circular horizontal base 12 on which centrally rests vertical center post 14, vertically supported on its lower end portion at four sides by generally triangular base center post supports 16. A horizontal, cylindrical cross bar 18 has a central portion between opposing end portions 20, the central portion supported by post 14 at cross bar support 22 formed in the upper end portion of post 14. Cross bar support 22 conforms to the shape of cylindrical cross bar 18. A prayer rug R is shown hung over cross bar 18 for storage or display.

Figure 2:
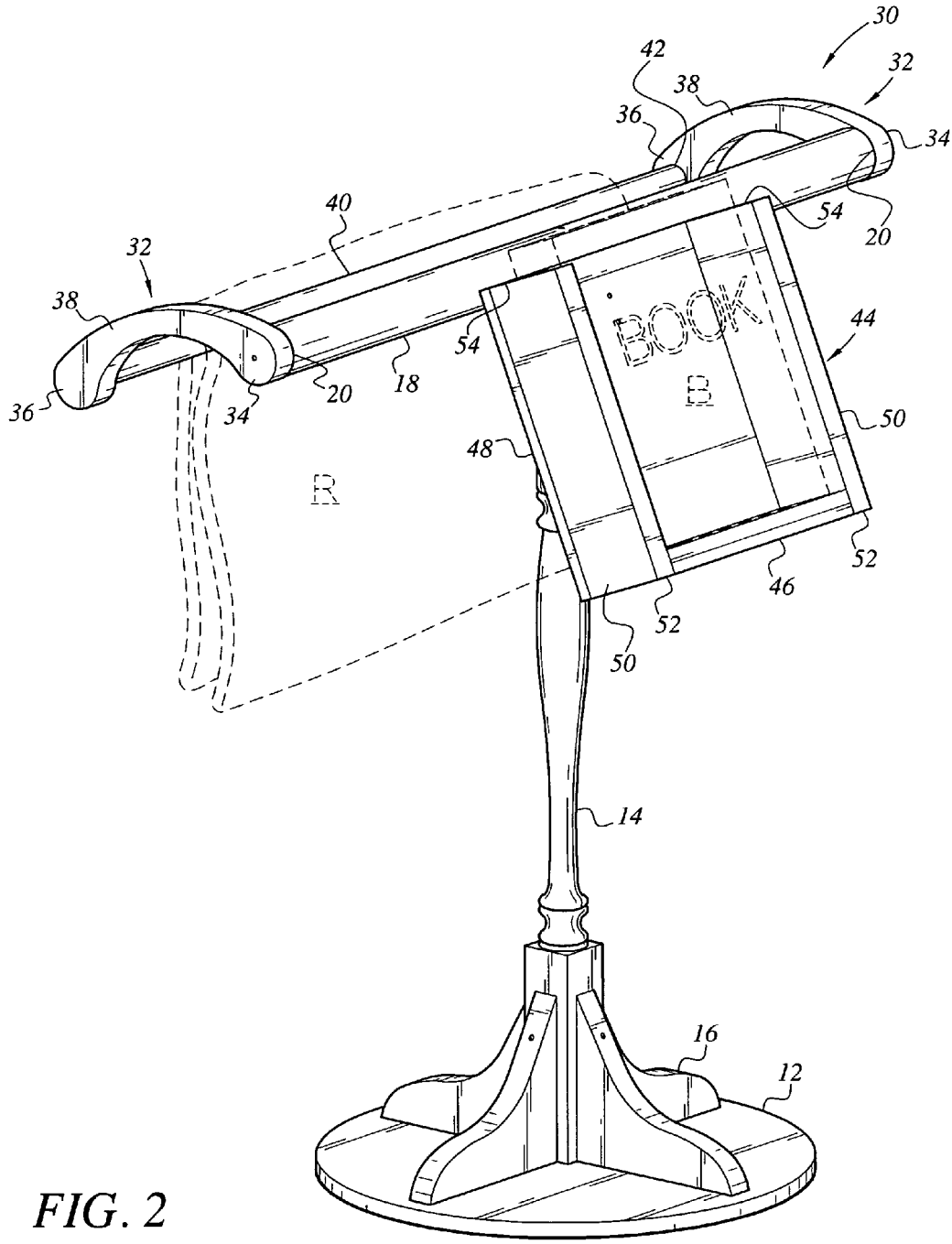
FIG. 2 is an environmental, front perspective view of a combination prayer rug/book stand according to the present invention.
Figure 3:
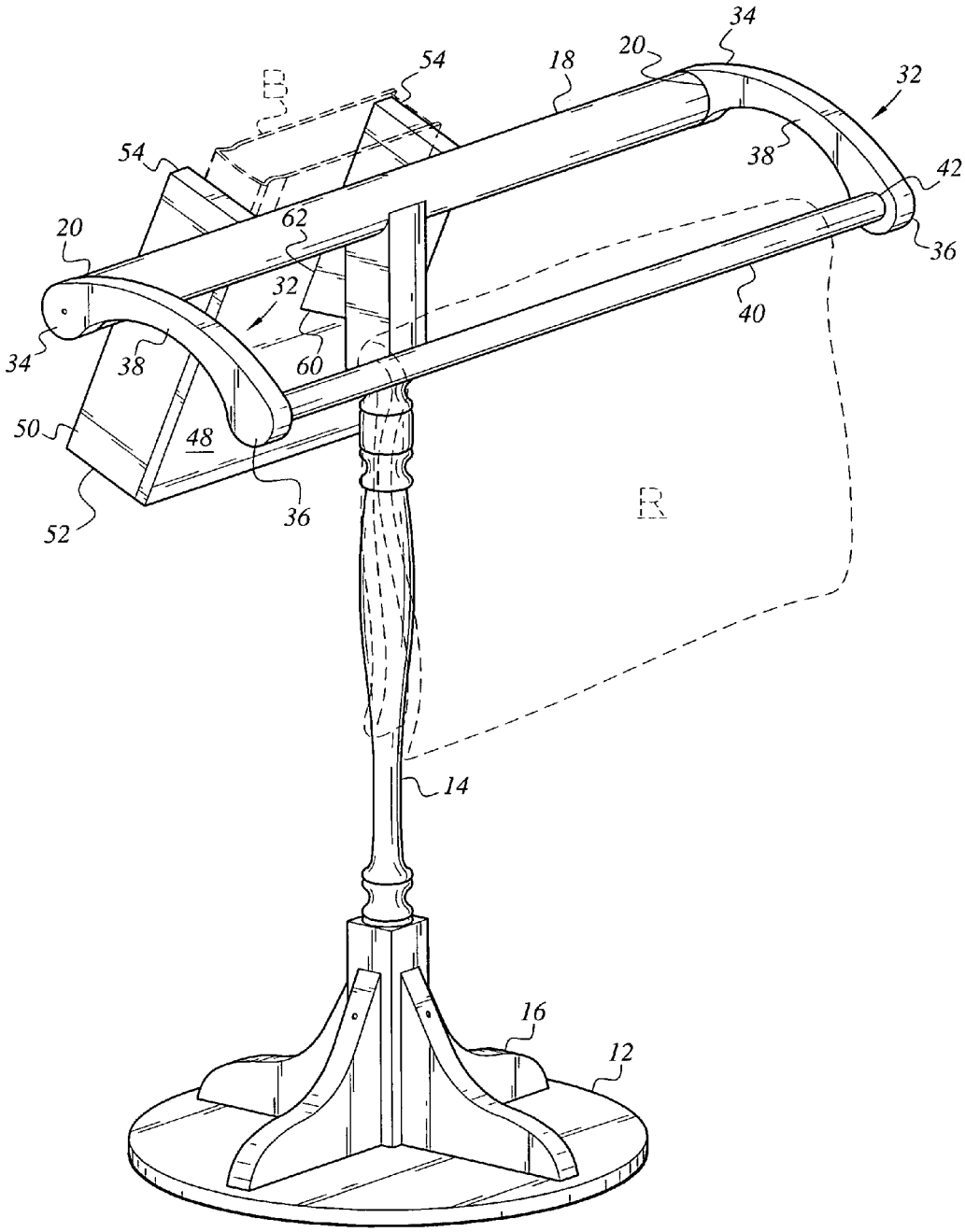
FIG. 3 is an environmental, rear perspective view of a combination prayer rug/book stand of FIG. 2.
Figure 4:
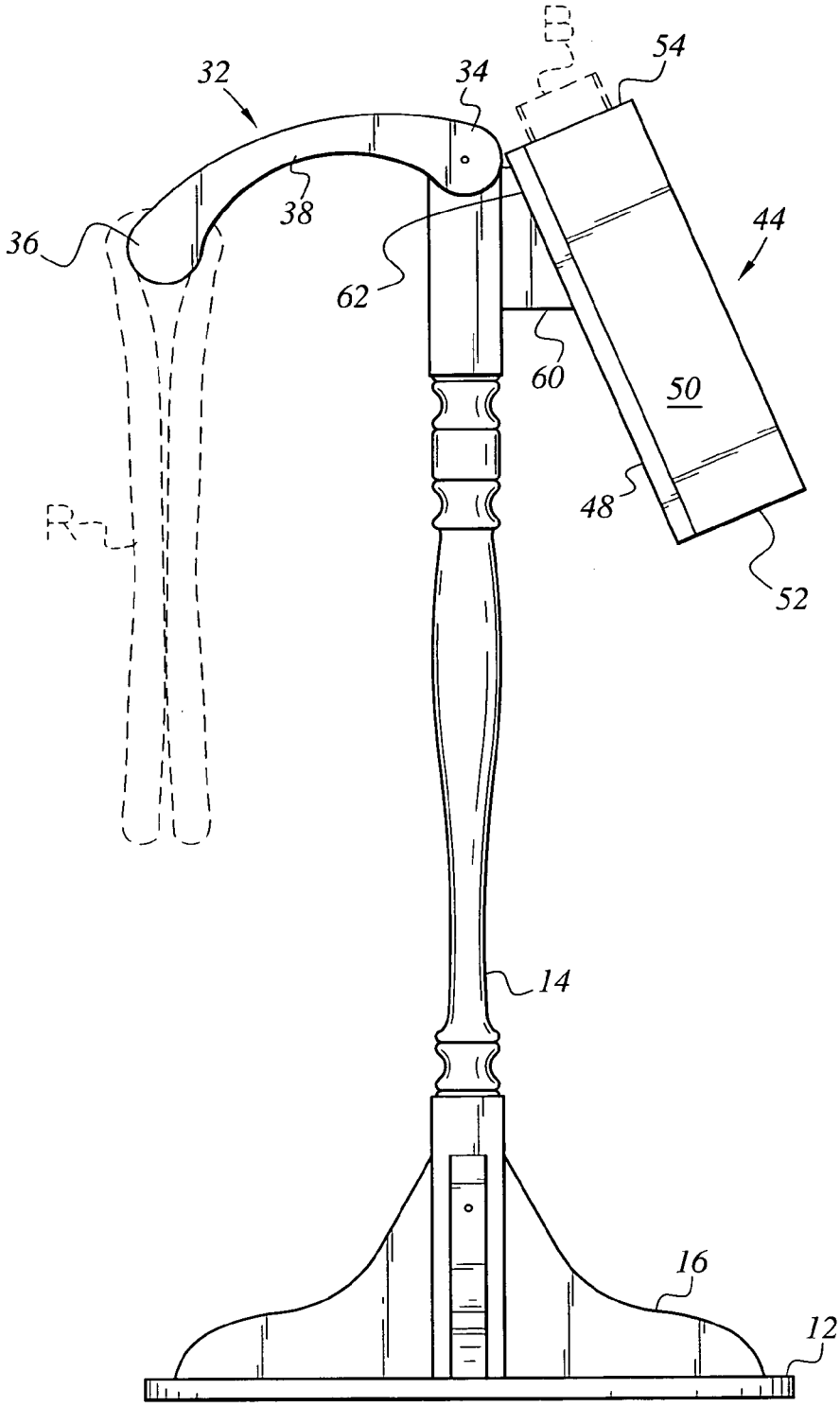
FIG. 4 is a side elevation view of the combination prayer rug/book stand of FIG. 2.

Referring to FIGS. 2, 3, and 4, there are shown front and rear perspective views and a side elevation view of another embodiment combination prayer rug/book stand 30 which includes the base 12, vertical center post 14, base center post supports 16 and cylindrical horizontal cross bar 18 having opposing end portions 20 and centrally supported at cross bar support 22 arranged as in the embodiment of FIG. 1. Arched end brackets 32 are attached at each cross bar end portion 20 at respective crossbar attachment ends 34 by conventional means such as nails, screws, adhesive, or dowels. Arched end brackets 32 support rug suspension bar 40 at respective rug suspension bar end portions 36. Rug suspension bar 40 is spaced from a first side of horizontal cross bar 18 by the arched bracket portions 38 of arched brackets 32, allowing space for hanging prayer rug R over the rug suspension bar 40 as shown. Rug suspension bar 40 is connected to arched bracket 32 at rug suspension bar opposing ends 42 by any conventional means such as nails, screws, adhesive, or dowels.

Book support 44 is attached to the upper end portion 20 of center post 14 on a second side opposite the rug suspension bar 40 to avoid interference with the rug R as hung. Book support 44 has a book support base 46 extending outward from and perpendicular to a back wall 48 and has side walls 50 having lower ends 52 attached at lateral ends of support base 46 and extending upward along the back wall 48 to free upper ends 54. Book support 44 is of such dimensions as to accept and fully support a Holy book B, in particular the QURAN, for storage and display thereon.

As best seen in FIGS. 3 and 4, book support 44 is supported along its back wall 48 at an outward angle by substantially triangular book support bracket 60 such that the upper end of the book support 44 is mounted near center post 14 and the book support base is substantially spaced from the center post 14. This provides a more positive support for the holy book B, preventing it from tumbling forward from the support. The book support bracket 60 extends radially outward from the upper end portion of center post 14 and supports the book support back wall 48 at its upper center portion along bracket angled outer edge 62.

The prayer rug and book support stand of the present invention may include a Dikra beads holder such as a dowel or the like conveniently placed such as extending outward from the base 46 of book support 44. A lamp of appropriate conventional size and design may be attached to the prayer rug and book support stand of the present invention, the lamp being supported so as to illuminate the book as supported on the book support 44 for reading.

The prayer rug and book support stand of the present invention is preferably made of finished wood for an attractive appearance, but may be made of any appropriate material such as plastic or metal.

It is to be understood that the present invention is not limited to the embodiments described above, but encompasses any and all embodiments within the scope of the following claims.

I claim:

1. A prayer rug/book stand, comprising:

a horizontal base;

a center post having an upper end portion and a lower end portion;

said center post lower end portion being vertically mounted on said horizontal base;

a horizontal cross bar having opposing end portions;

said horizontal cross bar being mounted centrally between said opposing end portions upon said center post upper end portion;

a rug suspension bar having opposed ends;

said rug suspension bar being parallel with and spaced from a first side of said horizontal cross bar;

opposed end brackets extending between respective said end portion of said horizontal cross bar and said end portion of said suspension bar; and a book support mounted at said upper end portion of said center post on a second side thereof opposite said first side of said horizontal cross bar;

whereby a prayer rug is suspended on said rug suspension bar and a Holy book, more particularly the QURAN, is supported in said book support for their respective convenient storage, display, and ease of recognition between periods of use.

2. The prayer rug/book stand of claim 1, further comprising at least one base center post support extending between said horizontal base and said vertical center post.

3. The prayer rug/book stand of claim 2, wherein there are a plurality of base center post support extending between said horizontal base and said vertical center post.

4. The prayer rug/book stand of claim 1, wherein said end brackets are arched.

5. The prayer rug/book stand of claim 1, wherein said book support comprises a book support base and a back wall extending upward from and perpendicular to said book support base.

6. The prayer rug/book stand of claim 5, said book support has opposed sidewalls having respective lower ends attached at said book support base and respective free upper ends, said sidewalls extending upward from said book support base along said back wall.

7. The prayer rug/book stand of claim 6, further comprising a generally triangular book support bracket extending radially outward between said upper end portion of said vertical center post and said back wall, said book support bracket having an angled outer edge extending along the central portion of said back wall upward and inward along said back wall relative to said vertical center post, whereby said back wall and book are supported at an outward angle and spaced from said center post.

8. The prayer rug/book stand of claim 1, said horizontal base being round in shape.

9. A prayer rug/book stand, comprising:

a horizontal base;

a center post having an upper end portion and a lower end portion;

said center post lower end portion being vertically mounted on said horizontal base;

a horizontal cross bar having opposing end portions;

said horizontal cross bar being mounted centrally between said opposing end portions upon said center post upper end portion;

a rug suspension bar having opposed ends;

said rug suspension bar being parallel with and spaced from a first side of said horizontal cross bar;

opposed end brackets extending between respective said end portion of said horizontal cross bar and said end portion of said suspension bar; and a book support mounted at said upper end portion of said center post on a second side thereof opposite said first side of said horizontal cross bar;

said book support having a book support base and a back wall extending upward from and perpendicular to said book support base;

said book support having a generally triangular book support bracket extending radially outward between said upper end portion of said vertical center post and said back wall, said book support bracket having an angled outer edge extending along the central portion of said back wall upward and inward along said back wall relative to said vertical center post, whereby a prayer rug is suspended on said rug suspension bar and a Holy book, more particularly the QURAN, is supported in said book support for their respective convenient storage, display, and ease of recognition between periods of use.

10. The prayer rug/book stand of claim 9, wherein said end brackets are arched.

11. The prayer rug/book stand of claim 9, said horizontal base being round in shape.

12. The prayer rug/book stand of claim 9, further comprising at least one base center post support extending between said horizontal base and said vertical center post.

13. The prayer rug/book stand of claim 10, wherein there are a plurality of base center post support extending between said horizontal base and said vertical center post.

* * * * *